United States Patent [19]

Baker, Jr.

[11] 4,205,603

[45] Jun. 3, 1980

[54] BRAKE MONITOR FOR PART-REVOLUTION MECHANICAL POWER PRESS

[75] Inventor: Edgar M. Baker, Jr., Owosso, Mich.

[73] Assignee: Aetna Industries, Inc., Centerline, Mich.

[21] Appl. No.: 24,411

[22] Filed: Mar. 27, 1979

[51] Int. Cl.[2] ..... B30B 15/14

[52] U.S. Cl. ..... 100/35; 72/26; 100/53; 192/129 A

[58] Field of Search ..... 100/35, 53, 99; 192/129 A; 72/26

[56] References Cited

U.S. PATENT DOCUMENTS

| | | | |
|---|---|---|---|
| 3,078,751 | 2/1963 | Hill | 100/53 X |
| 3,931,727 | 1/1976 | Luenser | 100/53 X |

FOREIGN PATENT DOCUMENTS

| | | | |
|---|---|---|---|
| 1151137 | 5/1969 | United Kingdom | 100/53 |

*Primary Examiner*—Billy J. Wilhite

*Attorney, Agent, or Firm*—Barnes, Kisselle, Raisch & Choate

[57] ABSTRACT

A method and system for monitoring brake performance in part-revolution clutch presses and the like comprising an overrun cam coupled to a switch for indicating passage of the press die beyond the nominal desired stop position and entry into a danger range indicative of impending brake failure. A control relay is coupled to the overrun cam switch for inhibiting press operation when impending brake failure is sensed. A time delay relay is coupled to a press operator responsive switch for inhibiting operation of the monitoring circuitry and permitting passage of the press die through the danger zone during normal press operation.

9 Claims, 2 Drawing Figures

BRAKE MONITOR FOR PART-REVOLUTION MECHANICAL POWER PRESS

Figure 2:
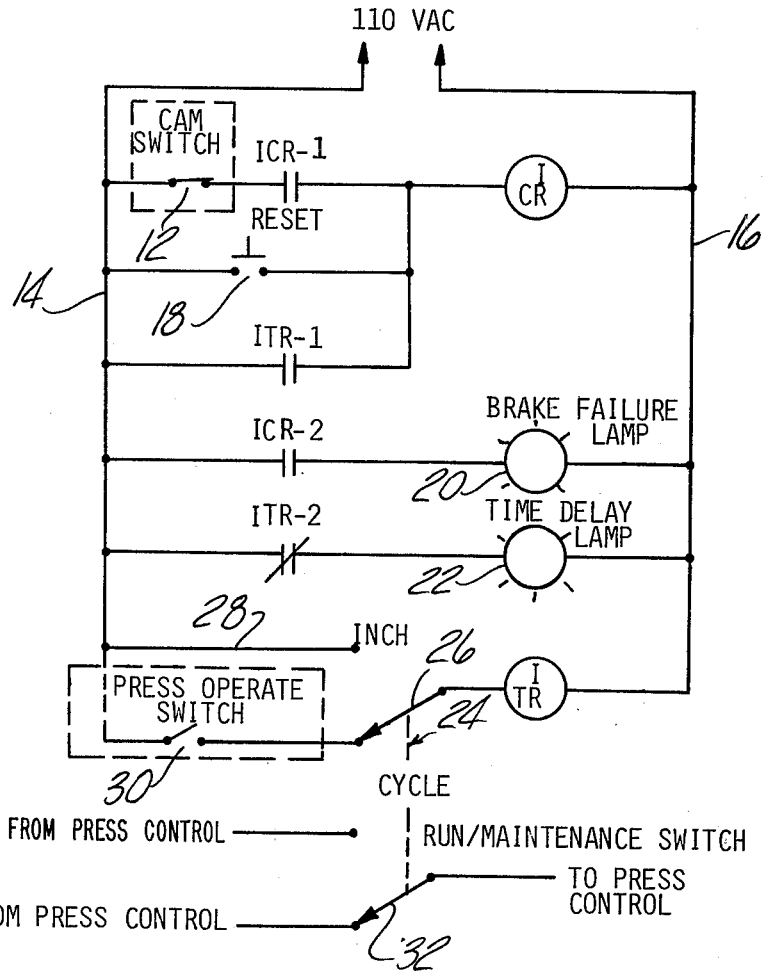
Figure 2:
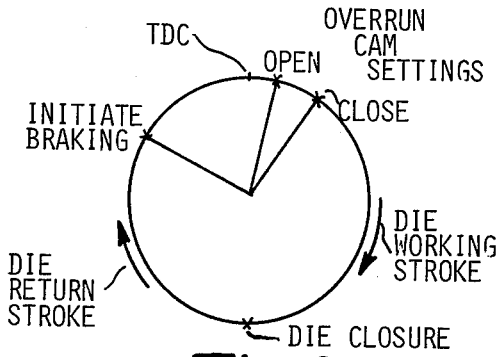

The present invention pertains to machine control, and more particularly to techniques for monitoring brake performance on part-revolution clutch presses and the like.

A part-revolution clutch press of the type to which the present invention is directed normally is adapted for manual activation by a press operator by depressing one or more "palm buttons." An operating cycle thereby is initiated consisting of a down or working stroke in which the press die descends toward and engages a work piece, and an up or return stroke in which the press die is withdrawn toward a "top dead center" position—i.e. fully raised. "Part revolution" connotes a press which is directly controlled by the palm buttons for only a portion of its working stroke, after which the die will complete the operating cycle even if the palm buttons are released. If, however, the palm buttons are released during an initial portion of the working stroke, the die must be braked before an operator can insert his hand into the zone of die closure.

The required relationship between press stopping time and the distance between the dies and palm buttons is specified in detail in Federal and many state OSHA regulations. Since press stopping time is a function of brake performance and wear, brake performance monitoring is a necessity in presses of the described type to insure operator safety. The ram or slide is automatically braked as it approaches the top dead center position and is intended to be held in this position until the palm buttons are again depressed. Thus, an additional potential danger has been recognized in power presses of the described type in situations where an operator must feed or remove work pieces from beneath the press die by placing one or both of his hands in the zone of die operation.

In an effort to overcome these potential dangers, brake monitoring apparatus have been proposed, and indeed are required by Federal and many state OSHA regulations for the reasons previously noted. Mechanical presses are conventionally provided by the manufacturer with a number of cams coupled to the ram drive shaft for monitoring ram position and initiating the several phases of ram operation, including the braking phase as the ram approaches top dead center on the return stroke. Conventionally, an extra field-adjustable cam switch is provided and may be used as a brake overrun sensing means in a top-stop on-line brake monitor. This is to say that brake performance is monitored as a function of the extent to which the ram overshoots the desired or nominal top dead center stopping point. See T. A. Hague "Brake Monitoring on Mechanical Power Presses", pages 28–29. A necessary feature not fully addressed in brake monitors previously proposed is the ability to distinguish between nominal braking at the end of an operating cycle, during which brake performance is to be monitored, and interruption by the operator during the downward or working cycle of the die.

It is an object of the present invention to provide a method and a circuit embodying such method for on-line monitoring of brake performance in mechanical presses and the like which are simple and economical in manufacture and reliable in operation, which include facility for overriding the brake monitor when it is desired to operate the press in a maintenance mode, and which include facility for distinguishing between an impending brake failure and intentional cycle interruption by the operator. A further object of the invention is to provide a press brake monitoring circuit which may be readily connected to the control electronics of existing presses.

Figure 1:
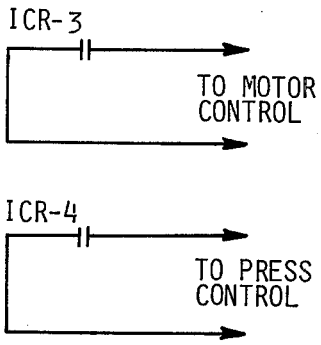

The invention, together with additional objects, features and advantages thereof, will be best understood from the following description, the appended claims and the accompanying drawings in which:

FIG. 1 is a schematic drawing of an exemplary but presently preferred embodiment of the brake monitoring circuit provided by the invention; and FIG. 2 is a graphic illustration of cam shaft operation during a press operating cycle and is useful in understanding operation of the invention.

Referring to FIG. 1, a presently preferred embodiment of the control circuit provided by the invention is illustrated and is adapted to be connected to the control electronics for operating the mechanical press (not shown) provided by the press manufacturer. Press control electronics may be of any conventional type, and the manner of connecting the circuitry of FIG. 1 thereto will be self-evident to the skilled artisan from the following description. Control elements provided as part of the press, specifically the adjustable brake overrun cam switch 12 and the press operate switch 30, and which are utilized in the present invention are enclosed by phantom lines in FIG. 1.

The preferred embodiment of the invention illustrated in FIG. 1 comprises a control relay 1CR and a time delay relay 1TR having contact sets suitably interconnected to indicate various control conditions as will be described in detail hereinafter. The contacts associated with each relay 1CR and 1TR are designated by identical reference indicia followed by a suffix, e.g. 1CR-1.

By way of background referring to FIG. 2 (not to scale), a press operating cycle begins with the die ram held by the brake (nominally) in the top dead center position TDC. When the press palm buttons are activated, switching arrangements in the control electronics coupled to the press release the brake and initiate operation of a drive motor to cycle the die through a downward or working stroke (clockwise in FIG. 2) and a subsequent return stroke. At some point in the return stroke, a cam (not shown) coupled to the ram drive shaft activates the press brake. The die ram is slowed and eventually stopped, desirably at the initial or nominal top dead center position. Continued operation inevitably results in brake wear which may eventually permit the die ram to pass the top dead center or nominal rest position before coming to a complete stop. As the stop position "creeps" down the working stroke portion of the cycle, a position may eventually be reached where the brake will be unable to support the weight of the die ram.

Preferably, in accordance with an important aspect of the present invention, the extra cam and switch provided by the press manufacturer is adjusted to operate as a brake overrun sensor to actuate its associated switch 12 (FIG. 1) in a selected angular range over the top dead center point for indicating impending brake failure. For example, it may be desirable to adjust the brake overrun cam to actuate its associated switch at a setting of five degrees beyond the nominal top dead center stoppoing point. Such an adjustment would correspond to allowable wear of the brake linings equivalent to five degrees of cam shaft rotation. The angular position of switch deactivation is not critical and would depend upon the design of the cam provided by the press manufacturer. In the example given, this angle may be seven degrees beyond the nominal ram stopping point. Thus, to continue the example, brake overrun cam switch 12 is actuated (opened) in the range of five to seven degrees beyond the nominal ram stopping point.

Referring to FIG. 1 in detail, 110 VAC utility power is connected to a pair of relay power buses 14,16. The actuator or coil of control relay 1CR is connected across buses 14,16 through a pair of normally open relay contacts 1CR-1 and the normally closed contacts 12 of the brake overrun cam switch adjusted as previously described. An operator-responsive push-button reset switch 18 and a pair of normally open contacts 1TR-1 associated with relay 1TR are connected in parallel with each other and in series with relay actuator 1CR. A brake failure lamp 20 and an adjustment time delay lamp 22 are connected across power buses 14,16 in series with normally open contact set 1CR-2 and normally closed contact set 1TR-2 respectively.

A double pole, double throw run/maintenance switch 24 has a first pole 26 for selectively connecting the actuator of relay 1TR across buses 14,16 through lead 28 in the maintenance position of switch 24, or through the normally open press operate switch 30 in the normal or run position of switch 24. Switch 30 closes in response to various control conditions in the press electronics, including depression of the press palm buttons, and remains closed while the palm buttons are depressed. A second pole 32 is provided in switch 24 for connection in the press control electronics for inhibiting operation of the press in the event that the run/maintenance switch normally provided as part of the press control electronics and run/maintenance switch 24 provided in accordance with the invention are not in identical switch positions. A pair of normally open contacts 1CR-3 and 1CR-4 associated with relay 1CR are provided for connection to the motor control and press control electronics to inhibit operation of the press in the event of a sensed impending brake failure.

In operation, assume that the press ram is in the top dead center position TDC (FIG. 2), such that cam overrun switch 12 is in its normally closed position. Reset switch 18 (FIG. 1) is depressed to energize relay 1CR and close contacts 1CR-1. Relay 1CR thus is latched in the energized condition through contacts 1CR-1 and closed cam switch 12. Lamp 20 is energized through contacts 1CR-2 to indicate normal operation, and contacts 1CR-3,1CR-4 are closed to permit normal operation of the press and motor control electronics (not shown). Assume further that run/maintenance switch 24 is in the normal or run position illustrated in FIG. 1. When the press operator activates his hand or palm buttons, the press control electronics closes normally open switch 30 to energize relay 1TR through switch pole 26. Contacts 1TR-1 close to latch relay 1CR energized independently of cam switch 12, and contacts TR-2 open to extinguish lamp 22. As the ram die begins its working stroke, the overrun cam passes through the working range of cam switch 12 previously described in connection with FIG. 2 and switch 12 opens. However, relay 1CR is held energized by closed time-delayed contacts 1TR-1. As the overrun cam passes beyond its operating range and continues its downward working stroke, switch 12 again is closed and control relay 1CR is energized via contacts 1CR-1 and switch 12.

Thus, in accordance with an important feature of the present invention, time delay relay 1TR cooperates with control relay 1CR and cam switch 12 to permit passage of the cam shaft and press die beyond the operating range of the overrun cam. The use of a time delay relay coupled to press operate switch is important. If the operator depresses the palm buttons and immediately releases them, the ram would pass by inertia through the cam switch operating range. If the press operate switch were connected directly to relay 1CR or to a second typical control relay, relay 1CR would have an opportunity to de-energize when cam switch 12 opens. However, in accordance with this feature of the invention, contacts 1TR-1 remain closed for an adjustable time period after switch 30 opens to permit the ram to pass through the overrun cam operating range without giving a false indication of impending brake failure.

The time delay of relay 1TR may be field adjusted to be greater than the time required for the press die to pass the operating range of the overrun cam, but must be less than the total ram cycle time required to return to the ram stopping point. Thus, the working and return strokes of the press die are completed, by which time relay 1TR is de-energized awaiting subsequent closure of press operate switch 30. Lamp 22 may conveniently be used by a press operator or set-up technician for adjusting the delay time of relay 1TR relative to the particular press to which the present invention is connected.

An impending brake failure is indicated by passage of the press die and cam shaft beyond the nominal ram stopping point and entry of the cam shaft into the overrun range of switch 12. Thus, if the cam shaft enters the cam operating range with contacts 1TR-1 open, indicating that an operator has not initiated a new press operating cycle, cam switch 12 opens and relay 1CR de-energizes. Contact sets 1CR-3 and 1CR-4 open to inhibit press operation, and lamp 20 is extinguised to indicate brake failure. Contact 1CR-3 and 1CR-4 are to be connected to the press control circuitry in any suitable manner for inhibiting operator initiations of a press cycle and consequent closure of switch 30. The brake monitor circuitry provided by the present invention may be reset for a normal operation by depression of reset switch 18. When it is desired to operate the press in a maintenance mode, switch 24 is thrown to connect relay 1TR directly across power buses 14,16 and thereby hold relay 1CR energized through closed contacts 1TR-1 independently of the cam switch condition.

Another important feature of the invention not readily apparent from the foregoing discussion lies in the fact that control relay 1CR inherently functions to inhibit any unwanted or accidental press activation upon activation of utility power after a power interruption. If power is interrupted, relay 1CR will deactivate and contacts 1CR-3 and 1CR-4 inhibit press operations. When power is reapplied, relay 1CR is not reactivated until reset swtich 18 is depressed.

Although the invention has been described in connection with a presently preferred embodiment thereof, it will be appreciated that any number of modifications and variations are contemplated. For example, the invention is not limited to electromagnetic relays of the type illustrated in FIG. 1. Thus, the term "relay" in the appended claims must be read as encompassing recognized solid state equivalent structures. Similarly, the invention is not limited to the exemplary settings for the overrun cam previously described. Nor, for that matter, is the invention limited to mechanical cam and switch arrangements for sensing ram position. Other suitable optical or electromagnetic transducers may readily be utilized for sensing the position of the press die.

The invention claimed is:

1. In combination with a part-revolution power press having a die ram adapted to operate through an operating cycle consisting of a working stroke portion as the die approaches a work point and a return stroke, first means adapted to be responsive to a press operator for initiating an operating cycle of the die ram, and brake means operative during the return stroke portion of the operating cycle for arresting motion of said die ram at a nominal rest point at the end of an operating cycle, a circuit for monitoring performance of said brake means and inhibiting operation of the press in the event of a potential brake failure comprising position sensing means operatively coupled to said die ram and responsive to travel of said die ram through a selected position between said nominal rest point and said work point, second means responsive to travel of said die ram through said selected position to inhibit press operation, third means responsive to said first means for setting a control condition when ram travel is initiated by a press operator, and fourth means responsive to said third means for inhibiting operation of said second means upon setting of said control condition such that said second means operates to inhibit press operation when said ram travels during said return portion of said operating cycle beyond said nominal rest point to said selected position.

2. The combination set forth in claim 1 wherein said third means comprises time delay means responsive to said first means for setting said control condition to inhibit operation of said second means for a time delay period.

3. The combination set forth in claim 2 wherein said time delay means comprises a time delay relay which activates in response to said first means and remains activated for a said time delay period beyond activation of said first means, said position sensing means comprises first switch means which opens in response to travel of said ram through said selected position, said second means comprises a control relay electrically connected in series with said switch, and said fourth means comprises normally open second switch means associated with said time delay relay and connected in parallel with said first switch means for holding said control relay energized when said first switch means opens.

4. The combination set forth in claim 3 further comprising momentary contact reset switch means connected in parallel with said first and second switch means.

5. The combination set forth in claim 4 further comprising third switch means having a first position for normal operation electrically connecting said time delay relay means to said first means, and a second position for maintenance operation for holding said time delay relay means energized independently of said first means and thereby inhibiting operation of said circuit.

6. In combination with a part-revolution clutch press having a die ram adapted to operate through an operating cycle consisting of a working down stroke portion as said ram leaves a ram rest position and approaches a work point and a return up stroke portion between the work point and the rest position, a brake operative during the return stroke portion to stop said ram at a said nominal rest position adjacent top dead center of the ram operating cycle such that wear of said brake means is characterized by movement of said rest position downwardly from said nominal rest position into said working stroke portion of said cycle, and operator responsive first means for initiating an operating cycle of said die ram, a brake monitor circuit comprising a position transducer coupled to said ram to sense passage of said ram through a position range between top dead center and the work point, control means responsive to said transducer for inhibiting operation of said press upon entry of said ram into said preselected position range, and time delay means responsive to said first means for inhibiting operation of said control means during passage of said ram through said position range under control of said first means.

7. The combination set forth in claim 6 wherein said transducer comprises a switch having a normally closed condition and an open condition during passage of said ram through said range, said control means comprises control relay means having a relay actuator connected in series with said transducer switch and control relay switch means coupled to said press, and said time delay means comprises time delay relay means having an actuator operatively connected to said first means and a normally open time delay relay switch connected in parallel with said transducer switch for controlling operation of said control relay actuator independently of said transducer switch for a preselected time after operator activation of said first means.

8. The combination set forth in claim 7 further comprising reset switch means connected in parallel with said transducer switch and said time delay relay switch.

9. A method of monitoring brake performance in a part-revolution clutch press wherein brake wear is characterized by travel of the press ram beyond a desired rest point at the end of an operating cycle, said method comprising the steps of: (a) establishing a danger point beyond said nominal rest point and sensing when said ram reaches said danger point; (b) distinguishing between (i) normal passage of said ram through said danger point at the beginning of an operating cycle in response to initiation of a press operating cycle by an operator and (ii) passage through said danger point at the end of a braking phase of said operating cycle, and (c) inhibiting operation of said clutch press in the event of occurrence of said condition (ii).

* * * * *